US005226466A

United States Patent [19]

Coddens

[11] Patent Number: 5,226,466

[45] **Date of Patent: * Jul. 13, 1993**

[54] WINDOW ASSEMBLY INCLUDING ADJUSTABLE BLIND

[76] Inventor: Dean A. Coddens, 1229 Sunnymede Ave., South Bend, Ind. 46615

[ * ] Notice: The portion of the term of this patent subsequent to Mar. 19, 2008 has been disclaimed.

[21] Appl. No.: 628,349

[22] Filed: Dec. 14, 1990

Related U.S. Application Data

[63] Continuation of Ser. No. 311,023, Feb. 16, 1990, Pat. No. 5,000,242.

[51] Int. Cl.[5] ..... E06B 9/38

[52] U.S. Cl. ..... 160/107; 160/176.1; 160/902; 49/64; 52/202

[58] Field of Search ..... 160/107, 168.1, 176.1, 160/178.1, 177, 902, 34; 49/64; 52/202, 208

[56] References Cited

U.S. PATENT DOCUMENTS

| | | | |
|---|---|---|---|
| 2,219,699 | 10/1940 | Owen | 52/202 |
| 2,288,465 | 6/1942 | Knudsen | 160/107 |
| 4,079,558 | 3/1978 | Gorham | 52/202 |
| 4,369,828 | 1/1983 | Tatro | 160/107 |
| 4,409,758 | 10/1983 | Dickerson et al. | 52/202 X |
| 4,459,778 | 7/1984 | Ball . | |
| 4,480,674 | 11/1984 | Anderson . | |
| 4,484,611 | 11/1984 | Anderson . | |
| 4,493,357 | 1/1985 | Anderson . | |
| 4,506,476 | 3/1985 | Haines | 49/64 |
| 4,513,804 | 4/1985 | Anderson . | |
| 4,515,201 | 5/1985 | Anderson . | |
| 4,561,223 | 12/1985 | Gold et al. | 52/202 |
| 4,588,012 | 5/1986 | Anderson | 160/107 X |
| 4,611,648 | 9/1986 | Anderson | 160/107 |
| 4,685,502 | 8/1987 | Spangenberg . | |
| 4,702,296 | 10/1987 | Anderson | 160/107 |
| 4,723,586 | 2/1988 | Spangenberg . | |
| 5,000,242 | 3/1991 | Coddens | 160/902 X |

*Primary Examiner*—David M. Purol
*Attorney, Agent, or Firm*—Barnes & Thornburg

[57] ABSTRACT

An apparatus is provided for securing a window covering to a window by attachment to the frame of a window pane in a manner which retains the window covering in spaced apart relation relative to the window pane. This apparatus can be snap-fit onto the window pane without use of penetrating fasteners. This apparatus also permits utilization in retrofit double pane arrangements and facilitates removal of individual window panes with the window covering as a single unit to avoid disconnection of through-window adjustment controls.

20 Claims, 5 Drawing Sheets

WINDOW ASSEMBLY INCLUDING ADJUSTABLE BLIND

This application is a continuation of application Ser. No. 07/311,023, filed Feb. 16, 1990, now U.S. Pat. No. 5,000,242.

BACKGROUND AND SUMMARY OF THE INVENTION

The present invention relates generally to window assemblies, and, more particularly, to double pane window assemblies which include an adjustable blind positioned between the exterior and interior window panes.

Multiple or double pane window assemblies are being utilized instead of single pane windows in many preexisting and new buildings to minimize heat transfer through the windows. The dead air space held between the external and interior window panes acts to minimize heat loss through the window during winter months while minimizing the amount of external thermal energy entering through the window into the interior during the summer months.

Many pre existing buildings were originally built with single pane windows. It is often desirable to retrofit or convert these single pane windows to double pane windows in order to reduce air conditioning and heating costs for the building. However, it is often prohibitably expensive and time consuming to remove existing single pane windows and replace them with double pane windows. Therefore, some prior devices have been designed to allow conversion of a single pane window having a conventional frame into a double pane window assembly. A typical prior device of this type is disclosed in U.S. Pat. No. 4,369,828 to Tatro.

It has also been desirable to use venetian or adjustable blinds and other window coverings in conjunction with windows. Such blinds can be closed to reflect direct sun rays which would otherwise enter into a room during a sunny summer day. Alternatively, the blinds can be opened to allow sunlight to enter into a room during cold winter days. Blinds have been used in conjunction with single pane windows and when so used, the blinds are normally located on the interior side of the window. However, use of blinds in this manner can have several drawbacks. The slats are exposed to circulating room air and, thus, dust particles tend to settle on the slats. Because the blind slats are in close proximity to each other, cleaning dusty slats can be a difficult task. Another drawback of previous blind arrangements is the fact that the blinds are left exposed and can be damaged by children, vandals or other individuals.

To overcome these drawbacks, it has been found desirable to place the blind between two window panes in a window assembly. Such an arrangement allows the horizontal slats of the blind to be isolated from the circulation of air in a room, thus minimizing the accumulation of dust and dirt thereon. Also, the slats are separated from direct contact with building occupants by a window pane, thus precluding potential damage to the blinds. Such arrangements are shown in U.S Pat. Nos. 4,611,648 and 4,685,502. In some previous prior devices of this type, the two window panes are hermetically sealed as a unit with the blind between them, thus isolated from dirt and moisture. Such an arrangement can readily be utilized in new building construction, but it can be very difficult and/or expensive to retrofit and hermetically seal an existing single pane window. In other devices, the seal between the two window panes is not as tight and, indeed, the interior pane is mounted so as to be removable or hinged to the window casing or building frame. In either arrangement, the blind or window covering between the two window panes is typically secured to the window casing or building frame exposed between the two window panes by screws, nails, or other suitable penetrating fasteners. Such arrangements usually require headrails, bottom rails and static slats in the blind construction. It has been suggested to hook the window covering directly to the window pane frame, but such arrangements can interfere with blind operation and result in scratches to the window pane surface.

In double pane windows with a blind positioned between the window panes, it is often desirable to provide a means of adjusting the angular orientation of the slats of the blind without opening up the window panes. Prior devices have included various adjustment or control mechanisms to allow this, including rotary mechanisms such as that disclosed in U.S. Pat. No. 4,459,778 to Ball and linear mechanisms such as that disclosed in U.S. Pat. No. 4,588,012 to Anderson. However, use of these arrangements can increase the difficulty of installing and cleaning the window panes and window covering because the controls require mounting connection through the window pane itself. Mounting a blind on the window casing, for example, would then require disassembly of the controls when cleaning the blind, especially where the blind is secured at its top and bottom. On the other hand, hooking the blind to the window pane itself to permit removing the blind and window Pane as a unit for cleaning could interfere with operation of these controls during normal use.

Accordingly, an object of the present invention is the provision of a double pane window assembly including a blind or window covering positioned between adjacent window panes which is readily adapted to be retrofit into existing single pane windows.

Another object is the provision of a double pane window assembly including an adjustable blind positioned between the two adjacent panes where the adjustable blind can be readily adjusted by an adjustment mechanism outside of the window assembly, and access to the interior adjustable blind is restricted.

A further object is to provide a simplified and economical insulating window assembly with a window covering mounted therein.

Still another object is to provide a double pane window assembly with simplified installation, repair, maintenance and replacement requirements.

Still another object is the provision of a double pane window assembly including an adjustable blind positioned between the two panes, which allows one window pane along with the adjustable blind assembly to be removed as a single unit.

Still another object is the provision of a double pane window assembly including an adjustable blind positioned between the two panes in accordance with the preceding objects and which will conform to conventional forms of manufacture, be of simple construction and easy to assemble so as to provide an assembly which will be economically feasible, long lasting and relatively trouble-free during assembly, disassembly and use.

These and other objects of the present invention are attained by the provision of an apparatus for securing a window covering to a window by attachment to the frame of a window pane in a manner which retains the window covering in spaced apart relation relative to the window pane. This apparatus can be snap-fit onto the window pane without use of penetrating fasteners. This apparatus also permits utilization in retrofit double pane arrangements and facilitates removal of individual window panes with the window covering as a single unit to avoid disconnection of through-window adjustment controls.

The present invention includes an interior window pane which is secured to an existing window opening at a location interior of the existing window pane by a simplified support structure. This support structure includes top and bottom U-channels and side rails which prevent the newly installed window pane from moving relative to the existing window pane after installation. Various seal arrangements, including magnetic, adhesive and VELCRO strips between the window pane frame and the support structure are contemplated by this invention.

The window covering is mounted between the existing and additional window panes by use of wing-shaped clips that are snap-fit to the top and bottom of the window pane frame. These clips position the window covering at a spaced apart relation from both window panes such that adjustment and operation of the window covering does not normally result in contact with either of the window panes. At the same time, since these clips permit the window covering to be secured directly to the window pane frame, the window pane frame and the window covering can be removed from the double pane window assembly as a unit for cleaning, repair or adjustment, without disassembly of the window covering controls where through-window controls are utilized.

Other objects, advantages and novel features of the present invention will readily become apparent to those of ordinary skill in the art from the following detailed description of the preferred embodiments considered in conjunction with the attached drawings.

DETAILED DESCRIPTION OF THE PREFERRED EMBODIMENTS

Figure 1:
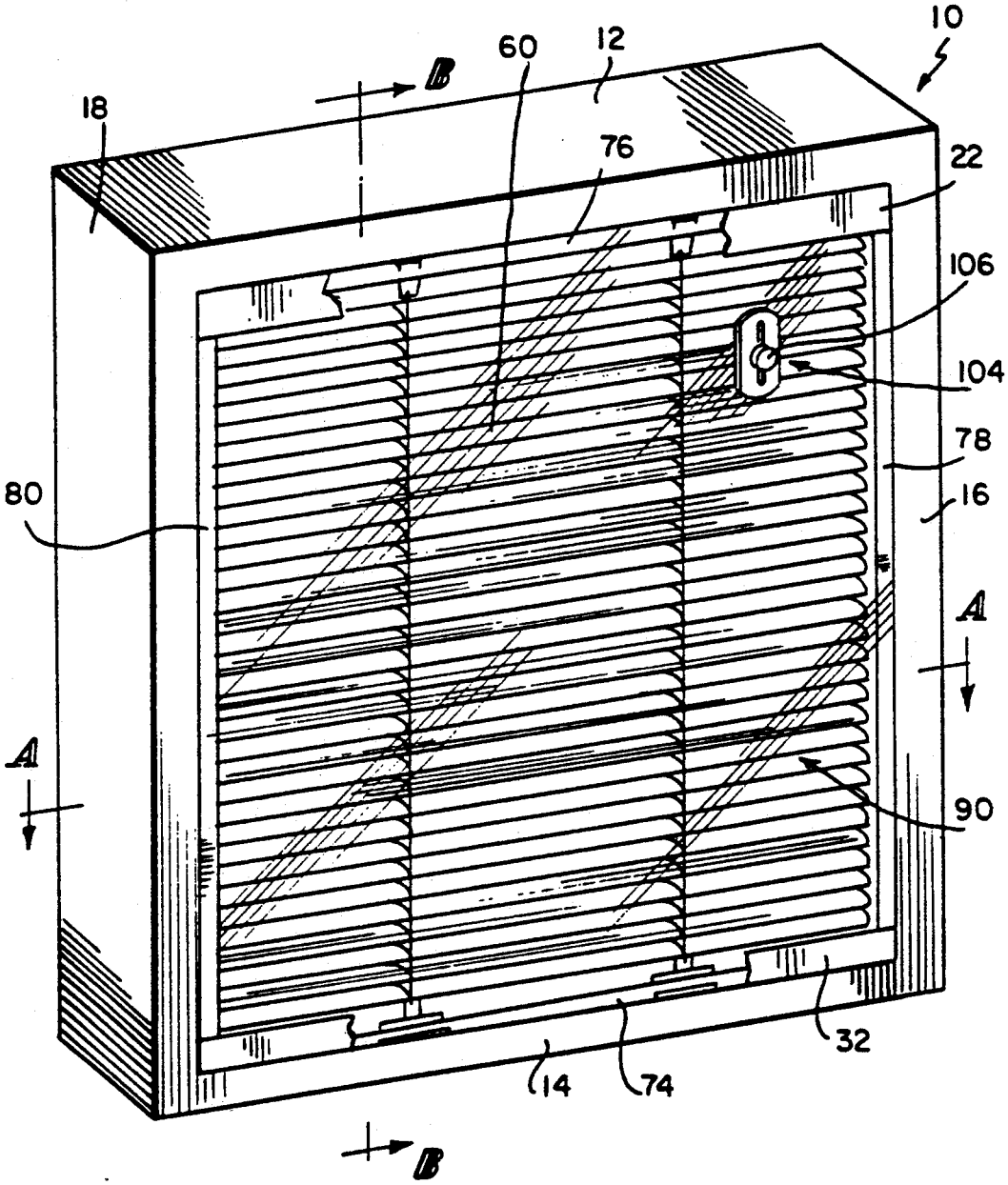
FIG. 1 is a perspective view of a preferred embodiment of the window assembly including adjustable blind with portions broken away.
Figure 2:
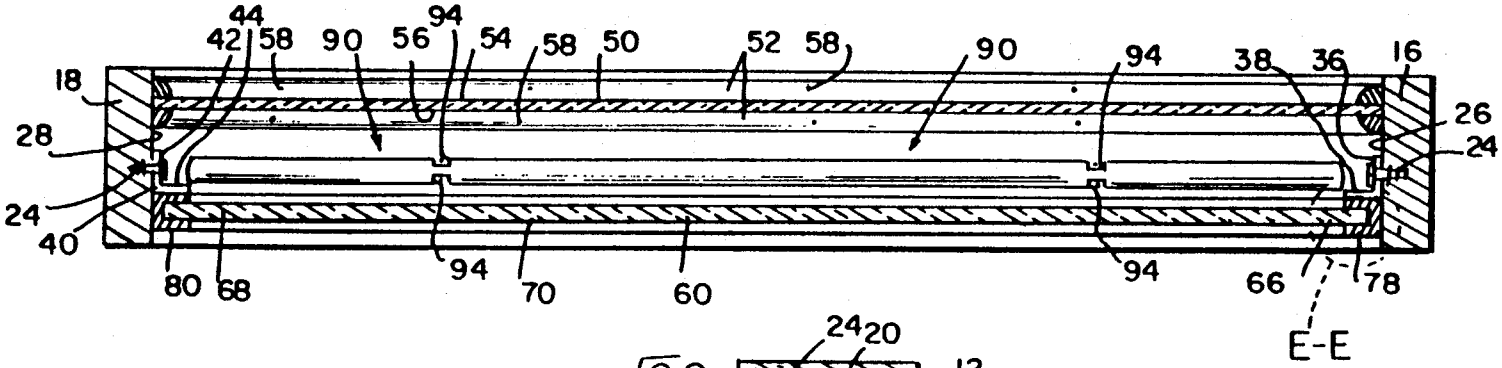
FIG. 2 is a horizontal cross-sectional view taken across lines A—A of FIG. 1.
Figure 3:
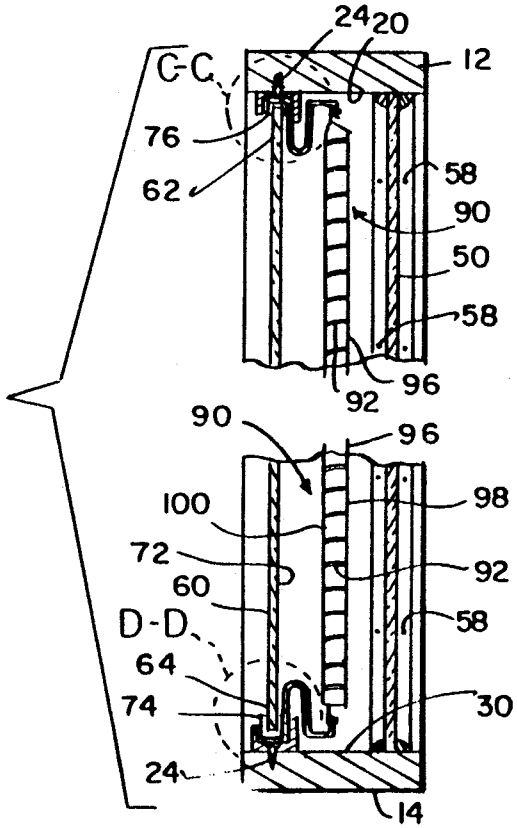
FIG. 3 is a vertical cross-sectional view taken across lines B—B of FIG. 1.
Figure 4:
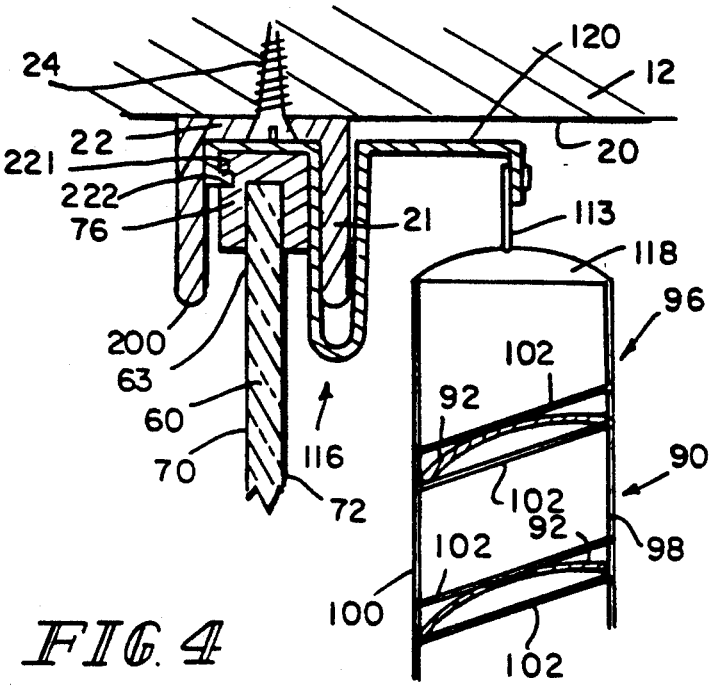
FIG. 4 is an enlarged cross-sectional view of the area indicated by Circle C—C in FIG. 3.
Figure 5:
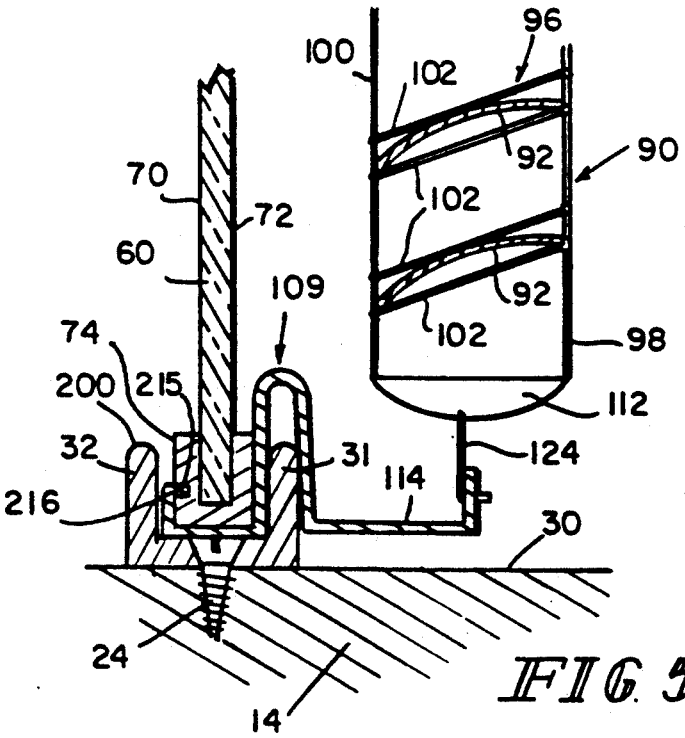
FIG. 5 is an enlarged cross-sectinoal view of the area indicated by Circle D—D in FIG. 3.
Figure 7:
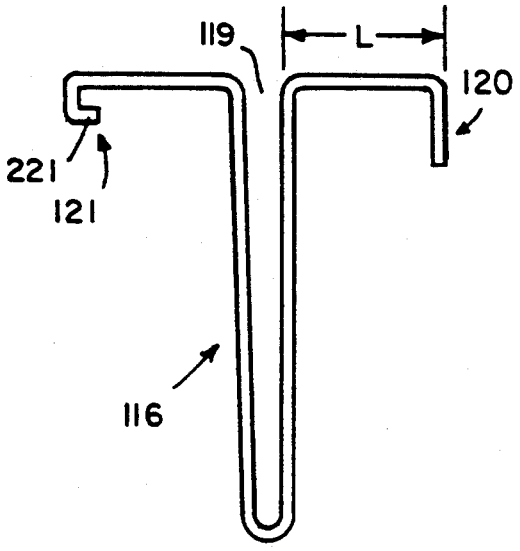
FIG. 7 is an enlarged side view of the top wing-shaped clip mechanism (without wire attachment means) in accordance with a preferred embodiment of the present invention.
Figure 6:
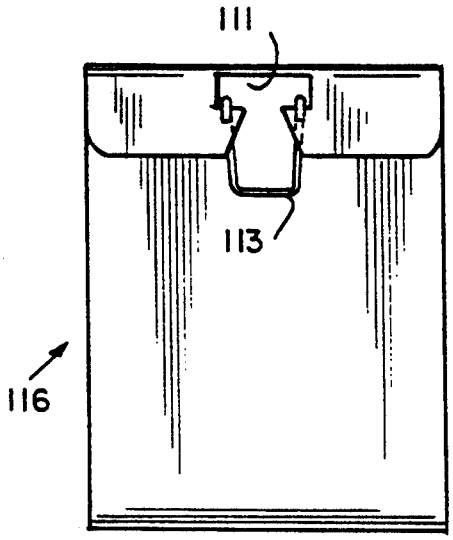
FIG. 6 is an enlarged front view of the top wing-shaped clip mechanism including wire attachment means in accordance with a preferred embodiment of the present invention.
Figure 8:
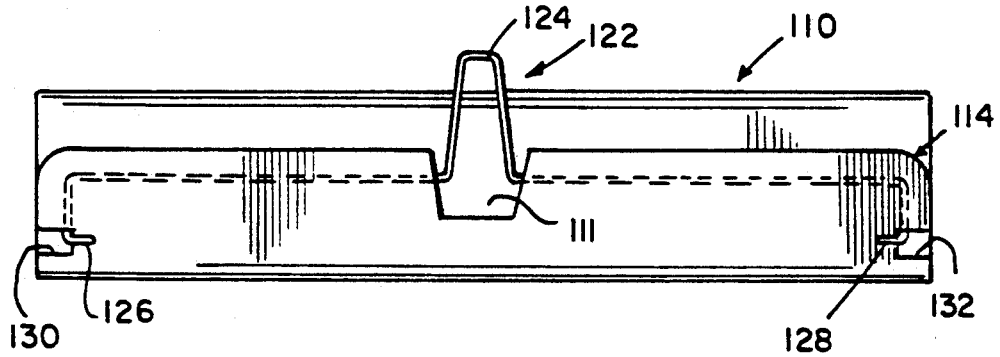
FIG. 8 is an enlarged front view of the bottom wing-shaped clip mechanism including wire attachment means in accordance with a preferred embodiment of the present invention.
Figure 9:
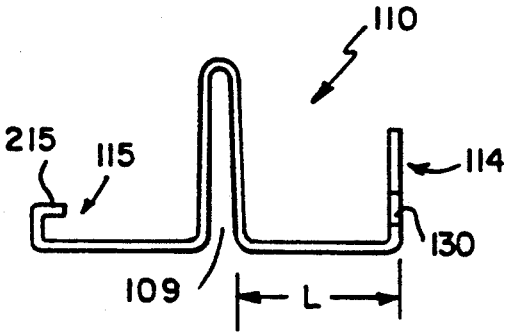
FIG. 9 is an enlarged side view of the bottom wing-shaped clip mechanism (without wire attachment means) in accordance with a preferred embodiment of the present invention.

Referring now to the drawings, in which like referenced characters indicate corresponding elements throughout the several views, attention is first directed to FIGS. 1–3 which illustrate a preferred embodiment of a double pane window assembly including adjustable blind using the present invention. This double pane window assembly is shown generally rectangular, corresponding to typical window openings in buildings, and consists of outer frame or window casing 10, exterior window pane 50, interior window pane 60 and adjustable blind 90 mounted therebetween. Outer frame 10 includes, for example, top portion 12, bottom portion 14 and two side portions, 16 and 18.

When applying the present invention to retrofit an existing window structure for improved thermal efficiency, exterior window pane 50 would represent the existing window and frame 10 would represent the existing window casing. The new or additional window pane would then be represented by interior window pane 60 and the support structure for mounting interior window pane 60 would be attached to outer frame 10. This support structure includes elements 22, 32, 34 and 40, as described below. Blind 90 is secured to pane 60, rather than outer frame 10, also as described below.

The lower surface 20 of top portion 12 preferably has a U-shaped channel 22 attached by means of one or more fasteners or screws 24. U-shaped channel 22 preferably extends horizontally from interior surface 26 of side portion 16 to interior surface 28 of side portion 18.

Upper surface 30 of bottom portion 14 preferably has U-shaped channel 32 attached thereto by means of one or more fasteners or screws 24. U-shaped channel 32 preferably extends horizontally from interior surface 26 of side portion 16 to interior surface 28 of side portion 18. In preferred embodiments, U-shaped channels 22 and 32 are fabricated from plastic, aluminum or other suitable material. Channel 32 is generally smaller in vertical dimension than channel 22 and is vertically spaced apart from channel 22 at their respective open end extremus 200 preferably by a distance just less than the vertical dimension of pane 60.

Interior surface 26 of side portion 16 preferably has right angle member 34 attached by means of at least one fastener or screw 24. Right angle member 34 is preferably orientated such that first leg 36 is attached flush against interior surface 26 of side portion 16 and extends towards exterior window pane 50. Second leg 38 extends, for example, perpendicularly away from interior surface 26 of side portion 16. Right angle member 34 preferably extends vertically from U-shaped channel 22 on top portion 12 to U-shaped channel 32 on bottom portion 14. Right angle member 34 is preferably aligned with channels 22 and 32 to simultaneously support the frame of pane 60.

Similarly, interior surface 28 of side portion 18 preferably has right angle member 40 attached by means of at least one fastener or screw 24. Right angle member 40 is preferably orientated such that first leg 42 is attached flush against interior surface 28 of side portion 16 and extends towards exterior window pane 50. Second leg 44 extends perpendicularly away from interior surface 28 of side portion 18. Right angle member 40 preferably extends vertically from U-shaped channel 22 on top portion 12 to U-shaped channel 32 on bottom portion 14 and supports the frame of pane 60 similarly to right angle member 34.

Preferably, second leg 38 of right angle member 32 and second leg 44 of right angle member 40 are positioned flush with vertical portion 21 of U-shaped channel 22 and with vertical portion 31 of U-shaped channel 32 to provide this support of the frame of pane 60.

Exterior window pane 50 is configured and supported within outer frame 10 according to conventional teachings. For example, pane 50 is dimensioned slightly smaller than the opening of outer frame 10. Exterior window pane 50 can be held in place by retention members 52 positioned flush with exterior surface 54 and interior surface 56 of exterior window pane 50. Retention members 52 are, for example secured to outer frame 10 by suitable fasteners or nails 58. Alternatively, pane 50 can be secured to the window casing by a conventional sash arrangement. Window panes 50 and/or 60 can be fabricated from glass, plastic or other transparent material.

Interior window pan 60 is typically configured and dimensioned to correspond generally with pane 50 and frame 10. As shown, pane 60 includes top portion 62, bottom portion 64 and two side portions 66 and 68, along with interior surface 70 and exterior surface 72. A frame is provided about the periphery of pane 60 as follows: bottom frame member 74 slides over bottom portion 64 and extends from side portion 66 to side portion 68; top frame member 76 slides over top portion 62 and extends from side portion 66 to side portion 68; two vertical frame members 78 and 80 slide over side portion 66 and side portion 68, respectively, and extend from top portion 62 to bottom portion 64. In preferred embodiments, the intersections between bottom horizontal support member 74, vertical side support members 78 and 80 and top horizontal support member 76 meet in 45 degree angles and the frame members are secured together by means of screws or other suitable fasteners (not shown).

An adjustable blind 90 is disposed between pane 50 and pane 60. Blind 90 is, for example, of conventional construction. As shown, blind 90 resembles that blind described in U.S. Pat. No. 4,702,296. That description is incorporated herein by reference. Thus, in general, blind 90 includes a preselected number of individual slats 92 which are preferably aligned horizontally and extend from vertical side support member 78 to vertical side support member 80. Individual slats 92 each preferably include four cutout notches 94. Individual slats 92 are held by means of a string chain 96 which includes exterior cord member 98 and interior cord member 100 and a series of cross-cords 102. Each individual slat is held in cutout notches 94 by exterior cord member 98, interior cord member 100 and two cross-cords 102.

Adjustment mechanism 104 is also provided in preferred embodiments of the present invention and includes rotary knob 106 and a means for converting rotary motion in rotary knob 106 into vertical longitudinal motion of string chain 96. Up and down movement of interior cord member 100 results in angular movement of individual slats 92. This mechanism is mounted to blind 90 through 60. Specifically, mechanism 104 is supported on surface 70 and extends through pane 60 to engage blind 90 adjacent surface 72.

Blind 90, or any other selected window covering, is secured to the frame members of pane 60 by wing-shaped clip members 110. Where blind 90 is preferably secured at the top and bottom of pane 60 (where, for example, vehicular vibration would otherwise cause the blind to bump against the pane when the window structure of this invention is used in a vehicle) two or four such clips 110 are used. In general, clips 110 snap onto the frame of pane 60 and elements 35 of the '296 patent mentioned above.

Wing-shaped clips 110 which attach to the bottom of pane 60 (on that portion of the frame of pane 60 if a frame is provided) include wing members 114. Elements 35 of the '296 patent (shown in the present figures as element 112) are preferably attached to first wing member 114 by means of a wire 122 having a depressed portion 124 and two ear members 126 and 128. Ear members 126 and 128 engage with cutouts 130 and 132 in wing member 114 to secure wire 122 to wing member 114. Top wing-shaped clips 116 include wing members 120. Elements 35 of the '296 patent (shown in the present figures as element 118) are attached to wing members 120 by means of a U-shaped wire 113 which engages with opening 111 in wing member 120.

The lengths L of wing members 114 and 120 are preferably at least as great as one-half the width of blind 90 such that when suspended between wires 113 and 124 blind 90 is not in contact with exterior surface 72 of pane 60. At the same time, pane 60 is preferably spaced interiorly of pane 50 by a distance sufficient to prevent blind 90 from coming into contact with the interior surface of pane 50 during normal installation and usage.

Wing member 115 of bottom wing-shaped clip 110 is preferably removably snapped over bottom frame member 74 of pane 60 to secure blind 90 to pane 60. Wing member 115 includes at its end hook 215 which is received within groove 216 of frame member 74. Slot 109 is located between wing member 114 and wing member 115. Vertical portion 31 of U-shaped channel 32 slides into slot 109 when pane 60 is installed in channel 32. Similarly, wing member 121 is preferably removably snapped over top frame member 76 of pane 60. Wing member 121 includes hook 221 which is received in groove 222 of frame member 76. Similarly, slot 119 is located between wing member 120 and wing member 122 and vertical portion 21 of U-shaped channel 22 slides into slot 119 when pane 60 is installed in channel 22. Grooves 216 and 222 can be specially supplied on the frame of pane 60 or, and preferably, can be formed co-extensive with grooves utilized for sealing and cushioning of pane 60 against support elements 22, 32, 34 and 40.

Figure 10:
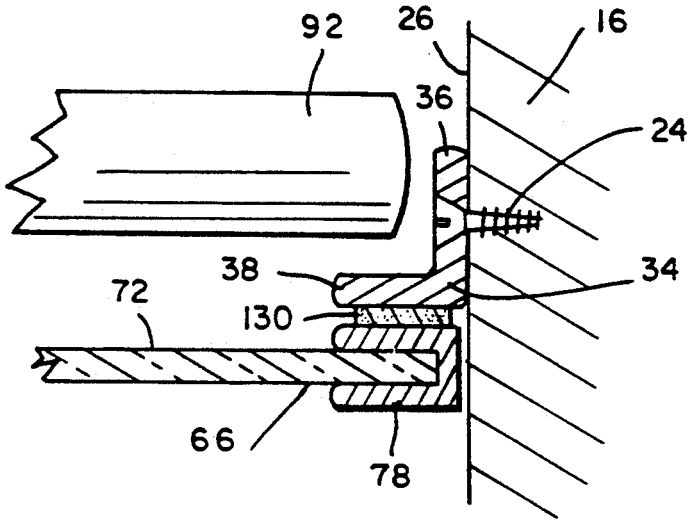
FIG. 10 is an enlarged cross-sectional view of the area indicated by Circle E—E in FIG. 2.

Various sealing and cushioning materials can be used between the frame of pane 60 and support elements 22, 32, 34 and 40. For example, magnetic strip 130 is shown in FIG. 10. This magnetic strip can function both to seal out air flow and to assist in retaining pane 60 to those support elements.

To assemble pane 60 and blind 90 into outer frame 10 top frame member 76 is first placed in U-shaped channel 22 and vertical portion 21 slides into slot 119 in top wing-shaped clip members 110. Pane 60 is then slid downwardly into U-shaped channel 32 until bottom frame member 74 enters U-shaped channel 32. As this occurs, top frame member 76 is moved toward exterior window pane 50 until side frame members 78 and 80 are flush with second leg 38 of right angle member 34 and second leg 44 of right angle member 40. In this position, magnetic backing strips 130 assist in retaining pane 60 in outer frame 10. The final step is to slide interior window pane 60 downward so bottom frame member 74 is secured in U-shaped channel 32 and vertical portion 31 slides into slot 109 in bottom wing-shaped clip members 110.

To disassemble this arrangement, a conventional glass mechanical suction cup device (not shown) is placed on interior surface 70 of pane 60 and then pane 60 is slid upwardly so that bottom frame member 74 clears U-shaped channel 32. When this occurs, the bottom portion 62 of pane 60 can be pulled away from outer frame 10 to clear U-shaped channel 32. In this position, pane 60 can be slid downward allowing top frame member 76 to clear U-shaped channel 22. At this time, pane 60 and blind 90 are independent from outer frame 10 and pane 50.

From the preceding description of the preferred embodiments, it is evident that the objects of the invention are attained and although the invention has been described and illustrated in great detail, it is to be clearly understood that the same is by way of illustration and example only and is not to be taken by way of limitation. The spirit and scope of this invention are to be limited only the terms of the appended claims.

For example, wing-shaped clips 110 of this invention are shown with use in a double pane assembly, but those of ordinary skill in the art will now recognize their usefulness in single pane arrangements to permit mounting of window coverings and the like without using penetrating feasteners. Also, wire 111 can be formed as looped in the '296 patent to provide greater spring tension in mounting blind 90.

What is claimed is:

1. A multiple pane window assembly including an adjustable blind, comprising:

an exterior window pane fixedly mounted in an outer frame;

said outer frame including a top member and a bottom member;

an interior window pane including a bottom portion and a top portion;

a bottom support member attached to said bottom member of said outer frame;

a bottom frame member substantially surrounded by said bottom support member, said bottom frame member attached to said bottom portion of said interior window pane;

a top support member attached to said top member of said outer frame;

a top frame member substantially surrounded by said top support member, said top frame member attached to said top portion of said interior window pane;

said adjustable blind including a top portion, a bottom portion and a plurality of individual slats;

a first attachment means for pivotally securing said top portion of said adjustable blind to said top support member such that said plurality of individual slats is held clear of said interior window pane;

a second attachment means for pivotally securing said bottom portion of said adjustable blind to said bottom support member such that said plurality of individual slats is held clear of said internal window pane; and a mounting means for removably installing said interior window pane to said outer frame.

2. The multiple pane window assembly of claim 1, wherein said mounting means includes at least one U-shaped channel secured to at least one of said top member of said outer frame and said bottom member of said outer frame for removably securing at least one of said bottom frame member and said top frame member.

3. The multiple pane window assembly of claim 1, wherein a first U-shaped channel is secured to said bottom member of said outer frame for removably securing said bottom frame member and a second U-shaped channel is secured to said top member of said outer frame for removably securing said top frame member.

4. The multiple pane window assembly of claim 3, further including:

a first right angle member secured to a first side member of said outer frame, said first right angle member formed from a magnetizable material;

a first magnetic means on a first side support member for magnetically engaging with said first right angle member;

a second right angle member secured to a second side member of said outer frame, said second right angle member formed from a magnetizable material; and a second magnetic means on a second side support member for magnetically engaging with said second right angle member.

5. The multiple pane window of claim 1, further including:

said first attachment means includes a first clip means mounted adjacent said top frame member for pivotally holding said top portion of said adjustable blind; and said second attachment means includes a second clip means mounted adjacent said bottom frame member for pivotally holding said bottom portion of said adjustable blind.

6. The multiple pane window assembly of claim 5, wherein:

said first clip means includes a first wing-shaped member including a first wing member, a second wing member and a slotted portion therebetween;

said first wing member of said first wing-shaped clip member mounts on said top support member;

said second wing member of said first wing-shaped clip member pivotally secures said top portion of said adjustable blind in a position such that said individual slats clear said interior window pane;

said second clip means includes a second wing-shaped clip member having a first wing member, a second wing member and a slotted portion therebetween;

said first wing member of said second wing-shaped clip member mounts on said bottom support member; and said second wing member of said second wing-shaped clip member pivotally secures said bottom portion of said adjustable blind.

7. A multiple pane window assembly including an adjustable blind installed in a window unit having an outer frame, comprising:

an exterior window frame fixedly mounted in said outer frame;

said outer frame including a top member, a bottom member, a first side member and a second side member;

an interior window pane including a bottom portion, a top portion, a first side portion and a second side portion;

a bottom support member attached to said bottom portion of said interior window pane;

a top support member attached to said top portion of said interior window pane;

a first side support member attached to said first side portion of said interior window pane;

a second side support member attached to said second side portion of said interior window pane;

said adjustable blind including a top portion, a bottom portion and a plurality of individual slats;

a first attachment means for securing said top portion of said adjustable blind to said top support member;

a second attachment means for securing said bottom portion of said adjustable blind to said bottom support member; and a mounting means for removably installing said interior window pane and said adjustable blind as an independent integral unit to said outer frame.

8. The multiple pane window assembly of claim 7, wherein said mounting means includes at least one U-shaped channel secured to at least one of said top member of said outer frame and said bottom member of said outer frame for removably securing at least one of said bottom support member and said top support member.

9. The multiple pane window of claim 8, wherein said at least one U-shaped channel includes a first U-shaped channel which is secured to said bottom of said outer frame for removably securing said bottom support member and a second U-shaped channel which is secured to said top of said outer frame for removably securing said top support member.

10. The multiple pane window assembly of claim 9, further including:

a first right angle member secured to said first side member of said outer frame, said first right angle member formed from a magnetizable material;

a first magnetic means on said first side support member for magnetically engaging with said first right angle member;

a second right angle member secured to said second side member of said outer frame, said second right angle member formed from a magnetizable material; and a second magnetic means on said second side support member for magnetically engaging with said second right angle member.

11. The multiple pane window assembly of claim 10, wherein:

said first attachment means includes an attachment for pivotally holding said top portion of said adjustable blind; and said second attachment means includes an attachment for pivotally holding said bottom portion of said adjustable blind.

12. The multiple pane window assembly of claim 7, wherein:

said first attachment means includes an attachment for pivotally holding said top portion of said adjustable blind; and said second attachment means includes an attachment for pivotally holding said bottom portion of said adjustable blind.

13. The multiple pane window assembly of claim 12, wherein:

said top member of said outer frame includes a vertical portion extending towards said bottom member of said outer frame;

said first attachment means includes a first wing-shaped clip member having a first wing member, a second wing member and a slotted portion therebetween;

said first wing member of said first wing-shaped clip member snaps over and mounts on said top support member;

said second wing member of said first wing-shaped clip member pivotally secures said top portion of said adjustable blind;

said slotted portion of said first wing-shaped clip member slidably engages said vertical portion of said top member of said outer frame;

said bottom member of said outer frame includes a vertical portion extending towards said top member of said outer frame;

said second attachment means includes a second wing-shaped clip member having a first wing member, a second wing member and a slotted portion therebetwee;

said first wing member of said second wing-shaped clip member snaps over and mounts on said bottom support member;

said second wing member of said second wing-shaped clip member pivotally secures said bottom portion of said adjustable blind; and said slotted portion of said second wing-shaped clip member slidably engages said vertical portion of said bottom member of said outer frame.

14. The multiple pane window assembly of claim 13, wherein:

said slotted portion of said first wing-shaped clip member is smaller in vertical height than said slotted portion of said second wing-shaped clip member; and said first U-shaped channel is smaller in vertical height than said second U-shaped channel.

15. A multiple pane window assembly including adjustable blind, comprising:

an exterior window pane fixedly mounted in an outer frame;

said outer frame including a top member and a bottom member;

an interior window pane including a bottom portion and a top portion;

a bottom support member attached to said bottom portion of said interior window pane;

a top support member attached to said top portion of said interior window pane;

said adjustable blind including a top portion, a bottom portion and a plurality of individual slats;

a first attachment means for pivotally securing said top portion of said adjustable blind to said top support member such that said plurality of individual slats is held clear of said interior window pane;

said top member of said outer frame including a vertical portion extending towards said bottom member of said outer frame;

said first attachment means includes a first wing-shaped clip member having a first wing member, a second wing member and a slotted portion therebetween;

said first wing member of said first wing-shaped clip member snaps over and mounts on said top support member;

said second wing member of said first wing-shaped clip member pivotally secures said top portion of said adjustable blind;

said slotted portion of said first wing-shaped clip member slidably engages said vertical portion of said top member of said outer frame;

a second attachment means for pivotally securing said bottom portion of said adjustable blind to said bottom support member such that said plurality of individual slats is held clear of said internal window pane;

said bottom member of said outer frame including a vertical portion extending towards said top member of said outer frame;

said second attachment means includes a second wing-shaped clip member having a first wing member, a second wing member and a slotted portion therebetween;

said first wing member of said second wing-shaped clip member snaps over and mounts on said bottom support member;

said second wing member of said second wing-shaped clip member pivotally secures said bottom portion of said adjustable blind;

said slotted portion of said second wing-shaped clip member slidably engages said vertical portion of said bottom member of said outer frame; and a mounting means for removably installing said interior window pane to said outer frame.

16. The multiple pane window assembly of claim 15, wherein said mounting means includes at least one U-shaped channel secured to at least one of said top member of said outer frame and said bottom member of said outer frame for removably securing at least one of said bottom support member and said top support member.

17. The multiple pane window assembly of claim 15, wherein a first U-shaped channel is secured to said top member of said outer frame for removably securing said top support member and a second U-shaped channel is secured to said bottom member of said outer frame for removably securing said bottom support member.

18. The multiple pane window assembly of claim 17, further including:

a first right angle member secured to said first side member of said outer frame, said first right angle member formed from a magnetizable material;

a first magnetic means on said first side support member for magnetically engaging with said first right angle member;

a second right angle member secured to said second side member of said outer frame, said second right angle member formed from a magnetizable material; and a second magnetic means on said second side support member for magnetically engaging with said second right angle member.

19. The multiple pane window assembly of claim 17, wherein:

said slotted potion of said first wing-shaped clip member is larger in vertical height than said slotted portion of said second wing-shaped member; and said first U-shaped channel is larger is vertical height than said second U-shaped channel.

20. A window assembly, including an adjustable blind, installed in an existing window unit having an outer frame, comprising:

an exterior window pane fixedly mounted in said outer frame;

said outer frame having a bottom member, a top member, a first side member and a second side member;

an interior window pane including a bottom portion, a top portion, a first side portion and a second side portion;

a bottom frame member at least partially surrounding said bottom portion of said interior window pane;

a top frame member at least partially surrounding said top portion of said interior window pane;

a first side frame member attached to aid first side portion of said interior window pane;

a second side frame member attached to said second side portion of said interior window pane;

a first right angle member secured to said first side member of said outer frame, said first right angle member formed from a magnetizable material;

a first magnetic means on said first side frame member for magnetically engaging with said first right angle member;

a second right angle member secured to said second side member of said outer frame, said second right angle member formed from a magnetizable material;

a second magnetic means on said second side frame member for magnetically engaging with said second right angle member;

amounting means for removably installing said interior window pane to said outer frame separately from said exterior window pane;

said mounting means including a first U-shaped channel element which is secured to said bottom member of said outer frame for removably securing said bottom frame member and a second U-shaped channel element which is secured to said top member of said outer frame for removably securing said top frame member;

said adjustable blind including a top portion, a bottom portion and a plurality of individual slats;

a first attachment means for securing said top portion of said adjustable blind to said top frame member;

said first attachment means comprised of a first clip means mounted on said top support member;

said first clip means including a first wing-shaped clip member including a first wing member, a second wing member and a slotted portion therebetween;

said first wing member of said first wing-shaped clip member mounts on said top support member;

said second wing member of said first wing-shaped clip member pivotally secures said top portion of said adjustable blind;

a second attachment means for securing said bottom portion of said adjustable blind to said bottom frame member;

said second attachment means including a second clip means mounted on said bottom support member;

said second clip means including a second wing-shaped clip member having a first wing member, a second wing member and a slotted portion therebetween;

said first wing member of said second wing-shaped clip member mounts on said bottom support member; and said second wing member of said second wing-shaped clip member pivotally secures said bottom portion of said adjustable blind.

* * * * *